US012114816B2

(12) United States Patent
Henderson et al.

(10) Patent No.: US 12,114,816 B2
(45) Date of Patent: Oct. 15, 2024

(54) TOILET CLOSURE SYSTEMS

(71) Applicant: Global Innovations, LLC, Seattle, WA (US)

(72) Inventors: Jeff Henderson, Seattle, WA (US); Michael A. Sprauve, San Jose, CA (US); Scott J. Foster, Richmond (AU); Ernesto Hueso, Glen Huntly (AU)

(73) Assignee: Global Innovations, LLC, Seattle, WA (US)

( * ) Notice: Subject to any disclaimer, the term of this patent is extended or adjusted under 35 U.S.C. 154(b) by 0 days.

(21) Appl. No.: 17/379,890

(22) Filed: Jul. 19, 2021

(65) Prior Publication Data

US 2021/0338023 A1 Nov. 4, 2021

Related U.S. Application Data

(62) Division of application No. 16/009,114, filed on Jun. 14, 2018, now Pat. No. 11,096,530.

(60) Provisional application No. 62/520,378, filed on Jun. 15, 2017.

(51) Int. Cl.
*A47K 13/10* (2006.01)

(52) U.S. Cl.
CPC ..... *A47K 13/10* (2013.01)

(58) Field of Classification Search
CPC ..... A47K 13/10; H02J 9/005
See application file for complete search history.

(56) References Cited

U.S. PATENT DOCUMENTS 5,504,947 A 4/1996 Robello et al.
5,570,478 A * 11/1996 Armstrong ..... A47K 13/12 4/246.1
5,592,700 A 1/1997 Genesse
(Continued)

FOREIGN PATENT DOCUMENTS

AU 2007221797 A1 10/2007
CA 2068693 A1 12/1992
(Continued)

OTHER PUBLICATIONS

International Search Report and Written Opinion for International Application PCT/US2018/037647, mailed on Oct. 2, 2018, 11 pages.
(Continued)

*Primary Examiner* — Janie M Loeppke
(74) *Attorney, Agent, or Firm* — Seed IP Law Group LLP

(57) ABSTRACT

A device can include one or more inputs, which, in operation, receive one or more signals indicative of toilet-lid positions and one or more signals indicative of user-toilet proximity; and control circuitry coupled to the one or more inputs. The control circuitry can, in operation, determine a position of a toilet lid based on the one or more signals indicative of toilet-lid positions; respond to a determination that the toilet lid is in a closed position by entering a power-save mode of operation; and respond to a determination that the toilet lid is not in a closed position by selectively generating, based on the one or more signals indicative of user-toilet proximity, toilet-lid-actuator control signals to cause a toilet-lid-actuator to move the toilet lid toward a closed position. Related methods and systems are also provided.

24 Claims, 11 Drawing Sheets

(56) References Cited

U.S. PATENT DOCUMENTS

| | | | | |
|---|---|---|---|---|
| 5,878,444 | A | 3/1999 | Convoy | |
| 5,907,873 | A | 6/1999 | Brandolf | |
| 6,067,667 | A | 5/2000 | Suzuki | |
| 6,393,624 | B1 | 5/2002 | Iwashita | |
| 6,526,600 | B1 | 3/2003 | Hernandez | |
| 7,380,292 | B1 | 6/2008 | Harris | |
| D572,808 | S | 7/2008 | Zhou | |
| 7,788,741 | B2 | 9/2010 | Lohss | |
| 7,966,674 | B2 | 6/2011 | Olowofela | |
| 8,739,321 | B2 | 6/2014 | Trout | |
| 9,198,548 | B2 * | 12/2015 | De Vito, Jr. | A47K 13/10 |
| 9,532,686 | B1 | 1/2017 | Heiss | |
| 9,657,472 | B2 | 5/2017 | Plate et al. | |
| 9,801,508 | B1 | 10/2017 | Hall et al. | |
| 2003/0019023 | A1 | 1/2003 | Furukawa et al. | |
| 2007/0056084 | A1 | 3/2007 | Watt et al. | |
| 2007/0056085 | A1 | 3/2007 | Dyson et al. | |
| 2008/0034486 | A1 | 2/2008 | Adams et al. | |
| 2010/0011493 | A1 | 1/2010 | Wiig et al. | |
| 2011/0047687 | A1 | 3/2011 | Lee et al. | |
| 2011/0145985 | A1 | 6/2011 | Lin | |
| 2012/0167292 | A1 | 7/2012 | Baumoel | |

FOREIGN PATENT DOCUMENTS

| | | | | |
|---|---|---|---|---|
| CN | 201515996 | U | 6/2010 | |
| CN | 201524027 | U | 7/2010 | |
| EP | 2882058 | A1 * | 6/2015 | E03D 9/08 |
| EP | 3 037 025 | A1 | 6/2016 | |
| EP | 3 070 211 | A1 | 9/2016 | |
| JP | H07-31561 | A | 2/1995 | |
| JP | 2000-139772 | A | 5/2000 | |
| JP | 2002-65514 | A | 3/2002 | |
| JP | 2002146878 | A * | 5/2002 | |
| JP | 2003-144348 | A | 5/2003 | |
| JP | 2004-124362 | A | 4/2004 | |
| JP | 2005-177457 | A | 7/2005 | |
| JP | 2006-61361 | A | 3/2006 | |
| JP | 2016-173021 | A | 9/2016 | |
| JP | 6487706 | B2 | 3/2019 | |
| WO | 2006/044343 | A1 | 4/2006 | |
| WO | 2016/177670 | A1 | 11/2016 | |

OTHER PUBLICATIONS

International Preliminary Report of Patentability for International Application PCT/US2018/037647, mailed on Dec. 26, 2019, 8 pages.

* cited by examiner

TOILET CLOSURE SYSTEMS

BACKGROUND

Technical Field

The present disclosure is related to toilets and, more particularly, to automated toilet seat and/or lid closure systems.

Description of the Related Art

Toilets can present a household hazard when users neglect to fully close a toilet lid after use. For example, children and pets have been known to play in the water contained in the toilet bowl even to the point of drinking from the toilet bowl or, in the extreme, falling into the toilet bowl. By closing the toilet lid, users prevent these hazards, by making the bowl less accessible to both children and pets.

The use of a toilet by multiple members of a household also presents some hazards and potential user stress. For example, male users tend to leave the seat and lid assembly in an open position after urination. When open, however, an inattentive and subsequent user might sit on the actual toilet bowl instead of the toilet seat, by acting on an assumption that the toilet is in a seat down, lid up position. While never pleasant, in the case of an elderly user, such an episode might cause injury, or at least discomfort in the actual sitting and recovery. Thus, in addition to being more aesthetically pleasing, a consistently closed lid and seat can prevent the spread of germs, possible injury, household arguments and, possibly, embarrassment to members of the household.

A number of alternate means have been proposed to close the toilet seat and toilet lid in some form of automation. For example, certain devices are designed to open and close the toilet lid and seat upon sensing an absence of a user in front of the toilet and a signal received from a toilet operational device indicating activation of a flushing step. Such devices are unwieldy, typically require that they be operational for relatively long durations to detect whether a flushing step has been undertaken, and therefore result in increasing power requirements, which results in external power supply connections, such as an outlet, for efficient operation. Some devices require non-compact, complex control systems that require continuous monitoring to detect users in front of the toilet and sending corresponding signals to systems remote from the toilet to operate toilet seats. Again, such devices have relatively significant power requirements due to continuous monitoring and communications with remote systems. Some devices are designed to control operation of both closing and opening the toilet seats and toilet lids based on detection of footwear of users. Again, such devices have relatively significant power requirements to operate both closing and opening of toilet seats and toilet lids, and employ external power sources. More generally, employing external power sources, as is typically required for toilet closure systems that open and close toilet seats and toilet lids, tends to be cost-prohibitive, as, for example, such would require a power outlet to be made available near the toilet. Further, having power outlets near toilets can result in unsightly structures having, for example, power cords or wires protruding from the toilets, and may also result in potential safety hazards.

BRIEF SUMMARY

In an implementation, a device comprises: one or more inputs, which, in operation, receive one or more signals indicative of toilet-lid positions and one or more signals indicative of user-toilet proximity; and control circuitry coupled to the one or more inputs, wherein the control circuitry, in operation: determines a position of a toilet lid based on the one or more signals indicative of toilet-lid positions; responds to a determination that the toilet lid is in a closed position by entering a power-save mode of operation; responds to a determination that the toilet lid is not in a closed position by selectively generating toilet-lid-actuator control signals to cause a toilet-lid-actuator to move the toilet lid toward a closed position based on the one or more signals indicative of user-toilet proximity.

In an implementation, a system comprises: an actuator, which, in operation, rotatably moves a toilet lid from an open position toward a closed position; one or more electrical energy storage devices; one or more sensors, which, in operation, generate one or more signals indicative of toilet-lid positions and one or more signals indicative of user-toilet proximity; control circuitry coupled to the actuator, the one or more electrical energy storage devices, and the one or more sensors, wherein the control circuitry, in operation: determines a position of a toilet lid based on the one or more signals indicative of toilet-lid positions; responds to a determination that the toilet lid is in a closed position by entering a power-save mode of operation; responds to a determination that the toilet lid is not in a closed position by selectively generating toilet-lid-actuator control signals to cause the toilet-lid-actuator to move the toilet lid toward the closed position based on the one or more signals indicative of user-toilet proximity.

In an implementation, a method comprises: determining by a toilet closure system, a position of a toilet lid; determining by the toilet closure system user-toilet-proximity; responsive to the toilet lid being in a closed position, entering a power-save mode of operation; and responsive to the toilet lid being in an open position and user-proximity, causing a toilet-lid-actuator to move the toilet lid toward a closed position.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with toilets, toilet closure systems, batteries, supercapacitors or ultracapacitors, power converters including but not limited to transformers, rectifiers, DC/DC power converters, switch mode power converters, controllers, and communications systems and structures and networks have not been shown or described in detail to avoid unnecessarily obscuring descriptions of the implementations.

Unless the context requires otherwise, throughout the specification and claims which follow, the word "comprise" and variations thereof, such as "comprises" and "comprising," are to be construed in an open, inclusive sense, that is, as "including, but not limited to."

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation.

The use of ordinals such as first, second and third does not necessarily imply a ranked sense of order, but rather may only distinguish between multiple instances of an act or structure.

Reference to electrical energy storage devices or batteries means a chemical storage cell or cells, for instance rechargeable or secondary battery cells, including, but not limited to, nickel cadmium alloy or lithium ion battery cells.

The headings and Abstract of the Disclosure provided herein are for convenience only and do not interpret the scope or meaning of the implementations.

Figure 1:
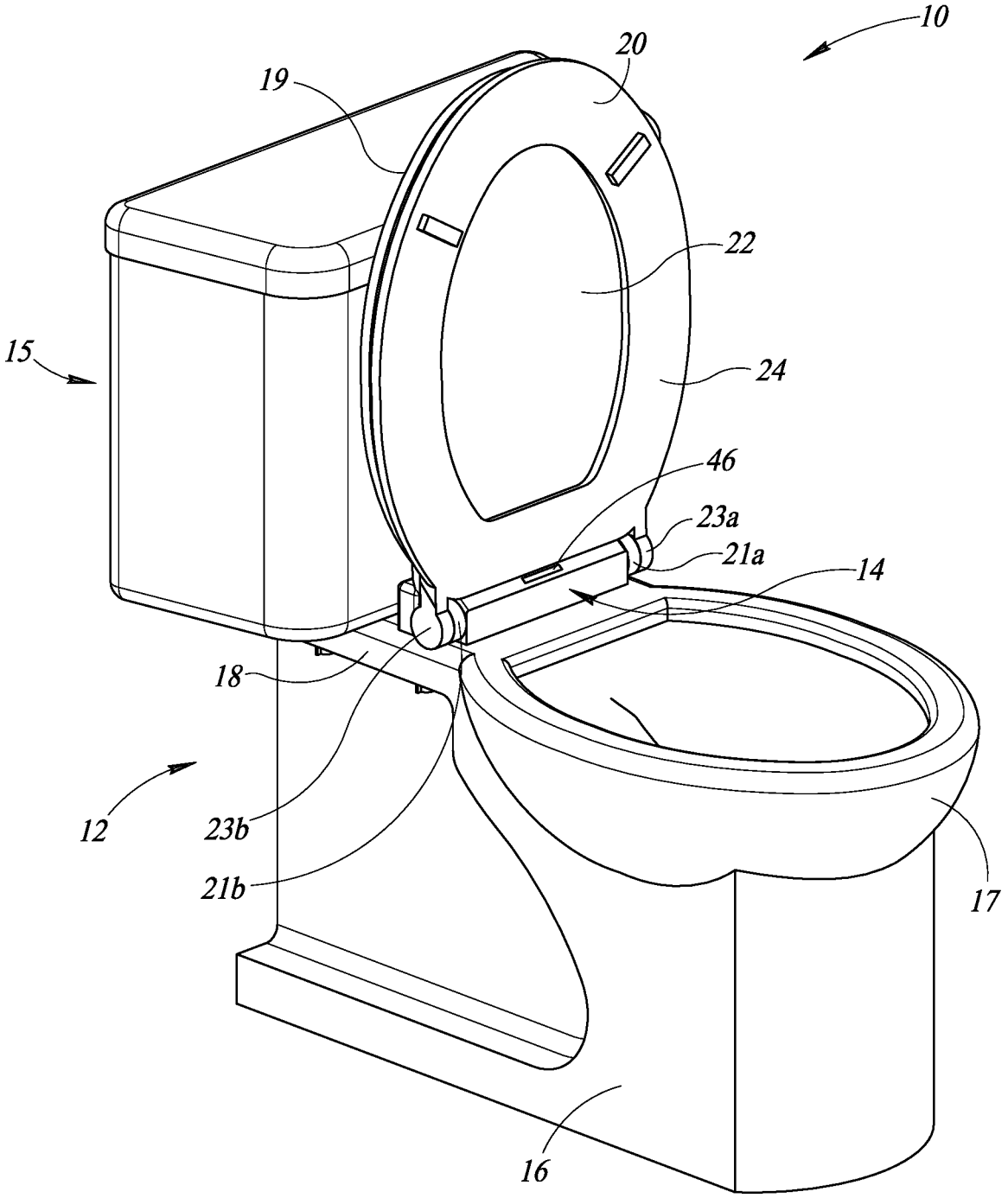
FIG. 1 is a perspective view of a toilet closure system, according to one non-limiting example implementation, illustrating a toilet in an open configuration.
Figure 2:
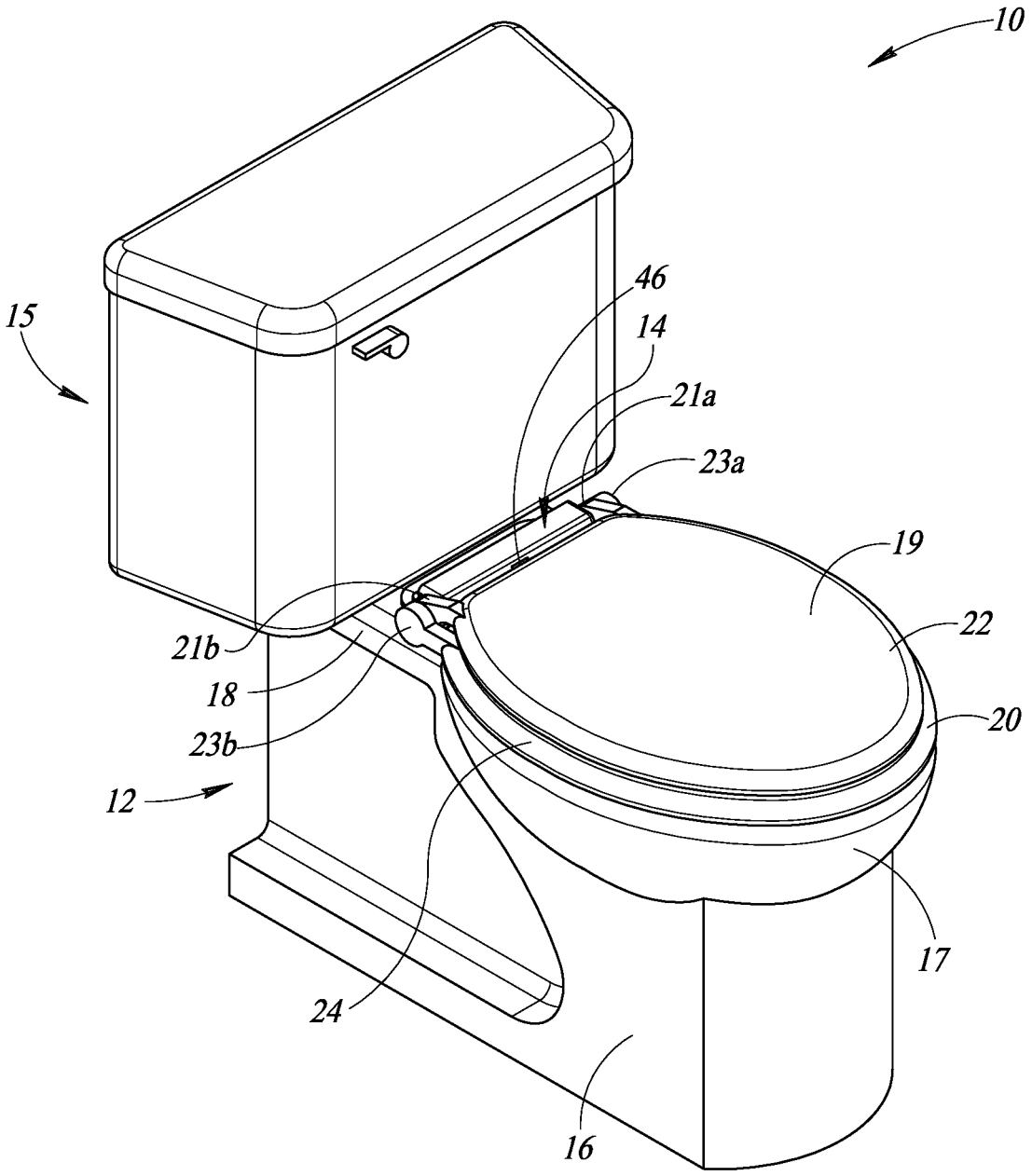
FIG. 2 is a perspective view of the toilet closure system of FIG. 1, illustrating the toilet in a closed configuration.

FIGS. 1 through 4 illustrate one example, non-limiting implementation of a toilet closure system 10. The toilet closure system 10 is generally operable to detect presence, absence and/or proximity to a toilet of a user and, based upon the detection, close a toilet lid 19 and/or a toilet seat 20 in an efficient and power-conserving manner. As illustrated in FIGS. 1 and 2, respectively, the toilet closure system 10 is operable so that a toilet can have open and closed configurations, where the toilet lid 19 and/or toilet seat 20 can move from the open position to the closed position.

The toilet closure system 10 includes a toilet 12 and a thrust system 14. The toilet 12 includes a tank assembly 15 and a base assembly 16. The base assembly 16 includes a bowl 17 and a bowl ledge assembly 18. The bowl ledge assembly 18 includes an upper surface for landing one or more components of the thrust system 14 and components of a toilet lid 19 and a toilet seat 20. In particular, the toilet lid 19 includes a pair of opposing toilet lid hinges 21*a*, 21*b* extending from a toilet lid cover body 22. The toilet seat 20 also includes a pair of opposing toilet seat hinges 23*a*, 23*b* extending from a toilet seat cover body 24.

The toilet seat hinge 23*a* includes a first seat aperture 25*a* that partially extends through a body of the toilet seat hinge 23*a* and has a cylindrical-shaped bore, and a second seat aperture 25*b* that partially extends through a body of the toilet seat hinge 23*b* and has a generally rectangular-shaped slot, although others shapes and structures are within the scope of the disclosed subject matter, for example, triangle-shaped, star-shaped, etc. The toilet lid hinge 21*a* includes a first lid aperture 26*a* that has a generally rectangular-shaped slot that extends through a body of the toilet lid hinge 21*a* and a second lid aperture 26*b* that extends through a body of the toilet lid hinge 21*b* that has a generally cylindrical-shaped bore. Again, other shapes and structures of the first lid aperture 26*a* are within the scope of the disclosed subject matter.

As illustrated in FIGS. 1 through 4, the toilet seat hinges 23*a*, 23*b* are positioned adjacent to the corresponding toilet lid hinges 21*a*, 21*b* to define a thrust system receiving region 27 in a manner that allows the first and second toilet lid apertures 26*a*, 26*b* to align with the corresponding first and second toilet seat apertures 25*a*, 25*b*.

Figure 3:
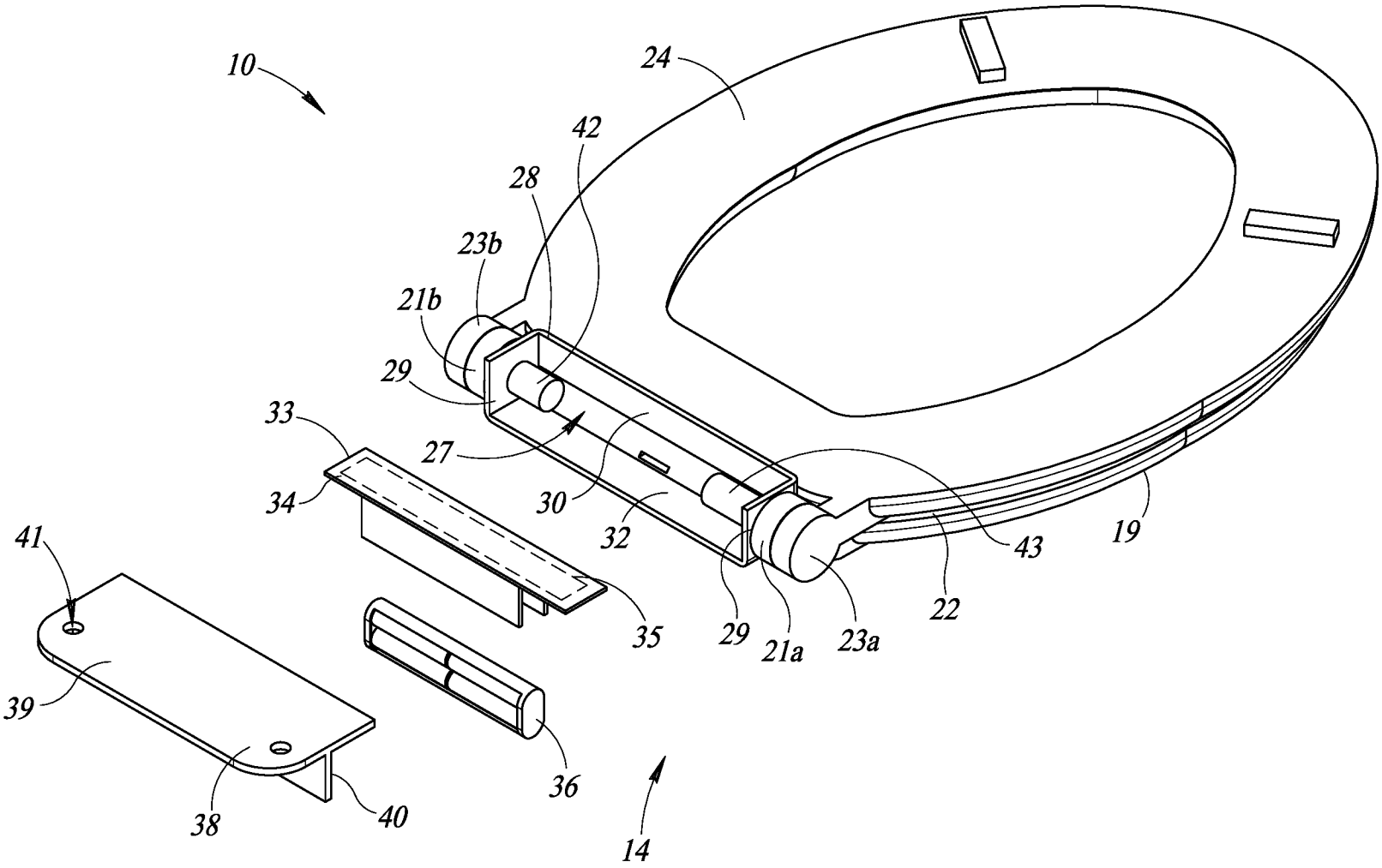
FIG. 3 is a partially exploded view of the toilet closure system of FIG. 1, with certain components removed for clarity.
Figure 4:
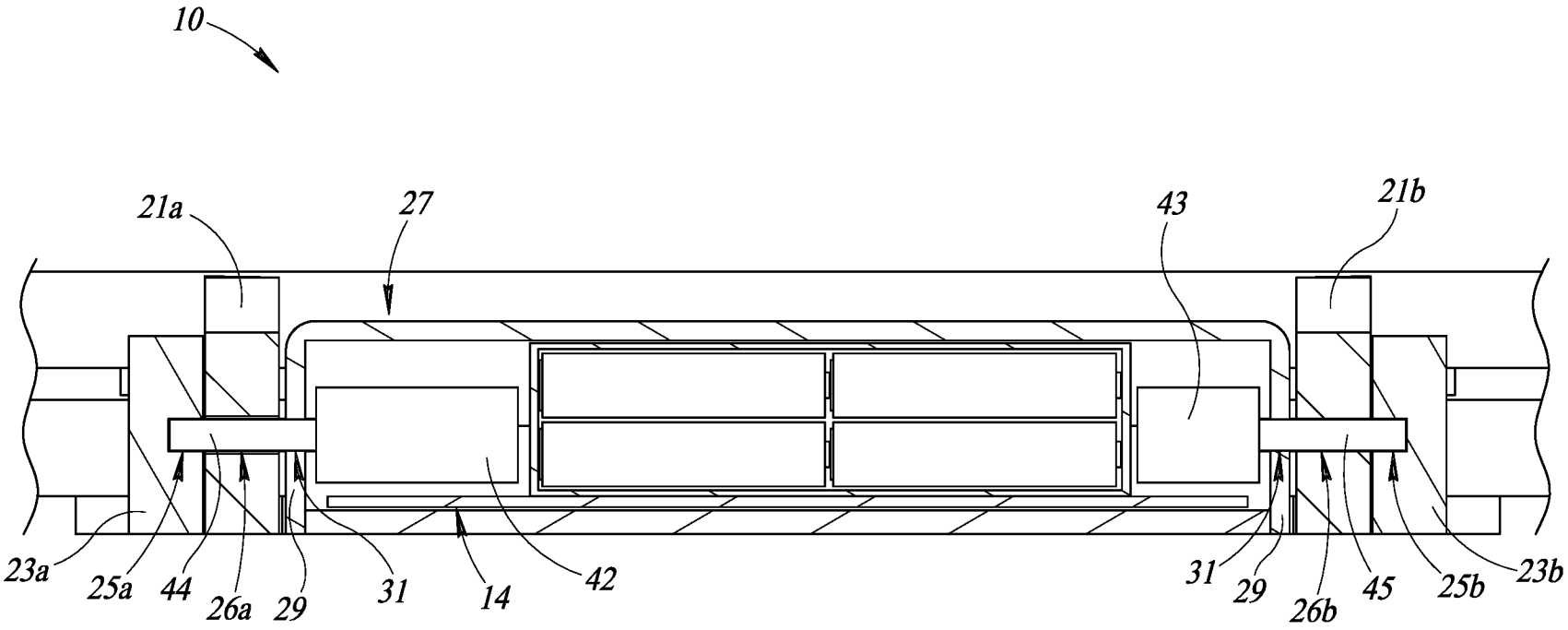
FIG. 4 is a cross-sectional view of the toilet closure system of FIG. 1.

As illustrated in FIG. 3, where certain components of the toilet closure system 10 have been removed for the sake of clarity of description and illustration, the thrust system 14 includes a housing 28 that is sized and shaped to house various components of the thrust system 14. The housing 28 includes a pair of side walls 29 that are positioned adjacent to corresponding toilet lid hinges 21*a*, 21*b* and a front wall 30 that is positioned adjacent to interior surfaces of the toilet lid cover body 22 and the toilet seat cover body 24. Each side wall 29 includes a shaft aperture 31 that extends therethrough. The housing 28 includes an upper wall 32 that extends outwardly from the front wall 30 and between the side walls 29.

The housing 28 also includes a control compartment 33. The control compartment 33 includes a base plate 34 which, in some implementations, includes an integrated toilet closure controller 35. In other implementations, however, the control compartment 33 can include a physically separate toilet closure controller 35 that can be received in the control compartment 33. A battery pack 36 extends outwardly from the base plate 34. The battery pack 36, in some applications, is sized and shaped to receive a plurality of electrical energy storage devices 50, for example, individual lithium-ion batteries that are packaged together to form the battery pack 36. More generally, such a battery pack 36 includes electrical components that make electrical connection between the plurality of individual lithium-ion batteries and primary negative and positive electrical terminals of the battery pack 36. The negative and positive electrical terminals of the battery pack 36 can be connected to corresponding negative and positive electrical terminals of various components of the toilet closure system 10, such as, for example, actuators, sensors, controllers, etc., to provide electrical power to such components, as described in more detail below.

The base plate 34 is sized and shaped to enclose a lower portion of the housing 28 by extending from a lower side of the front wall 30 and extending laterally between the pair of side walls 29. In this manner, when the base plate 34 encloses the housing 28, the battery pack 36 is received between the pair of side walls 29. The housing 28 also includes a bracket 38. The bracket 38 generally has a T-shaped cross-section having a base flange 39 and a vertical flange 40. The base flange 39 extends outwardly from a side of the base plate 34 and a lower surface of the base flange 39 mates with the bowl ledge assembly 18. As illustrated in FIG. 3, the base flange 39 includes one or more coupling apertures 41. The one or more coupling apertures 41 are sized and shaped to receive corresponding fasteners, which couple the housing 28 to the bowl ledge assembly 18. Although not shown for the sake of clarity of illustration, the bowl ledge assembly 18 includes corresponding apertures through which the fasteners are coupleably received to couple the housing 28 to the bowl ledge assembly 18. The vertical flange 40 is sized and shaped to couple to adjacent sides of the pair of side walls 29, which allows the bracket 38 to enclose the housing 28 from a rear side thereof.

In some implementations, one or more components of the housing 28 and/or the bracket 38 can be formed as a unitary structure. For example, in some implementations, the vertical flange 40 can be spaced apart from the front wall 30 such that the control compartment 33 can be removably coupled to the housing 28, via, for example, a snap-fit structure. Again, other forms of unitary or monolithic construction of one or more components of the housing 28, bracket 38, control compartment 33, etc., are within the scope of the disclosed subject matter.

With continued reference to FIGS. 1 through 4, the thrust system 14 includes an actuator 42 and a damper 43. The actuator 42, in some implementations, as illustrated in FIGS. 1 through 4, can be an electro-mechanical actuator. More generally, the actuator 42 is configured to provide rotary output to a drive shaft 44 by converting electrical energy into rotational motion. For example, in some implementations, the actuator 42 can include a motor that controls output of the drive shaft 44 and a gear train that provides at least one mechanical output from the actuator 42. In some implementations, the actuator 42 can take the form of a brush or brushless DC motor driving the drive shaft 44 through a torque-amplifying gear train. As such, a wide variety of electromechanical actuators are contemplated and within the scope of the disclosed subject matter.

The drive shaft 44 of the actuator 42 is sized and shaped to extend through the toilet lid hinge 21*a* and engage the rectangular-shaped slot of the first lid aperture 26*a*, while extending into the toilet seat hinge 23*a* via the first seat cylindrical-shaped aperture 25*a*. In this manner, the rotary movement of the drive shaft 44 rotatably moves the toilet lid 19. In some implementations, the actuator, e.g., actuator 42, can be coupled to a damper, e.g., damper 43. In such implementations, downward, rotary movement of the toilet lid 19 and/or toilet seat 20 toward the closed position can be dampened or controlled via the combination of the actuator and the damper coupled thereto, with a damper shaft coupling to the corresponding toilet seat hinge, e.g., toilet seat hinge 23*a*, 23*b*, and/or the toilet lid hinge, e.g., toilet lid hinge 21*a*, 21*b*. In some implementations, the drive shaft, e.g., drive shaft 44, of the actuator, e.g., actuator 42, can protrude from one end of a body of the actuator and be coupleably received in a slot or other aperture of a damper, e.g., damper 43. In such implementations, the drive shaft can further protrude from another end of the body of the actuator and be coupleably received in the corresponding toilet seat hinge, e.g., toilet seat hinge 23*a*, and/or the toilet lid hinge, e.g., toilet lid hinge 21*a*. In some implementations, a damper shaft of a damper, e.g., damper 43, can be coupleably received by and through the actuator, e.g., actuator 42, and into the corresponding toilet seat hinge, e.g., toilet seat hinge 23*a*, and/or the toilet lid hinge, e.g., toilet lid hinge 21*a*. Again, in such implementations, downward, rotary movement of the toilet lid 19 and/or toilet seat 20 toward the closed position can be dampened or controlled via the combination of the actuator and the damper coupled thereto. In some implementations, the actuator, e.g., actuator 42, can include a drive shaft, e.g., drive shaft 44, protruding from one side, with the damper, e.g., damper 43, being coupled to the actuator, for example in a manner where the damper slips on to the drive shaft of the actuator, such that the damper is sandwiched between the actuator and the toilet lid hinge, e.g., toilet lid hinge 21*a*, 21*b*.

The damper 43 can be any conventional damper which dampens or controls a rate of downward, rotary movement of the toilet seat 20. For example, in some implementations, the damper 43 includes a key or shaft 45 which has a rectangular or square shape that extends through the toilet lid hinge 21*b* via the second lid cylindrical-shaped aperture 26*b* and into the toilet seat hinge 23*b* to engage the rectangular-shaped slot of the second seat aperture 25*b*. In this manner, the damper 43 controls the rate of the downward, rotary movement of the toilet seat 20. As such, given this specific engagement of the drive shaft 44 of the actuator 42 and the shaft 45 of the damper 43 with the corresponding first and second lid apertures 26*a*, 26*b* and the first and second seat apertures 25*a*, 25*b*, the toilet seat 20 and the toilet lid 19 can be independently moved relative to each other between open and closed positions in a controlled manner. While FIGS. 1 through 4 illustrate toilet lid hinges 21*a*, 21*b* located interior to the corresponding toilet seat hinges 23*a*, 23*b*, in alternative implementations, the toilet seat hinges 23*a*, 23*b* can be located interior to the corresponding toilet lid hinges 21*a*, 21*b*.

Moreover, the thrust system 14 illustrated in FIGS. 1 through 4 includes a mechanical override system. In some implementations, the mechanical override system is configured to allow a user to manually rotate the toilet lid 19 from the open position to the closed position. For instance, the drive shaft 44 of the actuator 42 is configured to provide a counter-resistance force which restricts free, rotatable movement of the drive shaft 44. The mechanical override system of the thrust system 14, however, allows a user to rotate or move the toilet lid 19 to the downward position, or back to the open position, by a force which is sufficient to overcome the counter-resistance force of the drive shaft 44 of the actuator 42. In some implementations, the mechanical override system can deactivate or switch the actuator 42 to a shut-down mode when resistance caused by manual opening or closing of the toilet lid 19 is detected. In such implementations, normal operation can resume post-use of the mechanical override system. Moreover, although not illustrated for the sake of clarity of description and illustration, the toilet closure system 10 can include an external power switch that can power on or off the thrust system 14.

As illustrated in FIGS. 1 and 2, the thrust system 14 includes one or more sensors 46 disposed in or on the housing 28. The one or more sensors 46 can include proximity sensors, e.g., motion sensors, time of flight sensors, force sensors, capacitance activated switch sensors (i.e., touch sensors), active or passive infrared sensors, or any other type of suitable sensor. Although the one or more sensors 46 are illustrated as disposed in or on the housing 28, in alternative implementations, the one or more sensors 46 can be disposed in or around the toilet lid 19, the toilet seat 20, or any other suitable location of the toilet 12. In general, the one or more sensors 46 are configured to detect whether a user is either seated on the toilet seat 20 or is in proximity of the toilet 12 within a certain defined distance. For instance, the one or more sensors 46 can include a time of flight sensor. A time of flight sensor is generally configured for time of flight measurements, which includes measuring a length of time between an emitted signal and a received signal. A distance can be calculated based on this length of time. Single Photo Avalanche Diode (SPAD) arrays may be incorporated in time of flight sensors, where there is often a reference array and a return detection array. Each of the SPAD arrays receives the emitted signal. In this manner, the time of flight sensor can detect, based on the emitted and received signals, if a user is within a certain defined distance. In addition, the one or more sensors 46 can also include a capacitance activated switch sensor, or more generally, a touch sensor. The capacitance activated switch sensor is generally configured to detect whether a user is seated on the toilet seat 20.

The one or more sensors 46 are communicably coupled to the toilet closure controller 35 to communicate indications of the presence, absence, and/or proximity to a toilet of the user, which may be employed by the toilet closure controller 35. Further, the toilet closure controller 35 is operably coupled to the actuator 42 to controllably operate the actuator 42 during various phases of the toilet closure system 10, as described in further detail below. In some implementations, the toilet controller 35 can also controllably operate the damper 43 during various phases of the toilet closure system 10.

Figure 5:
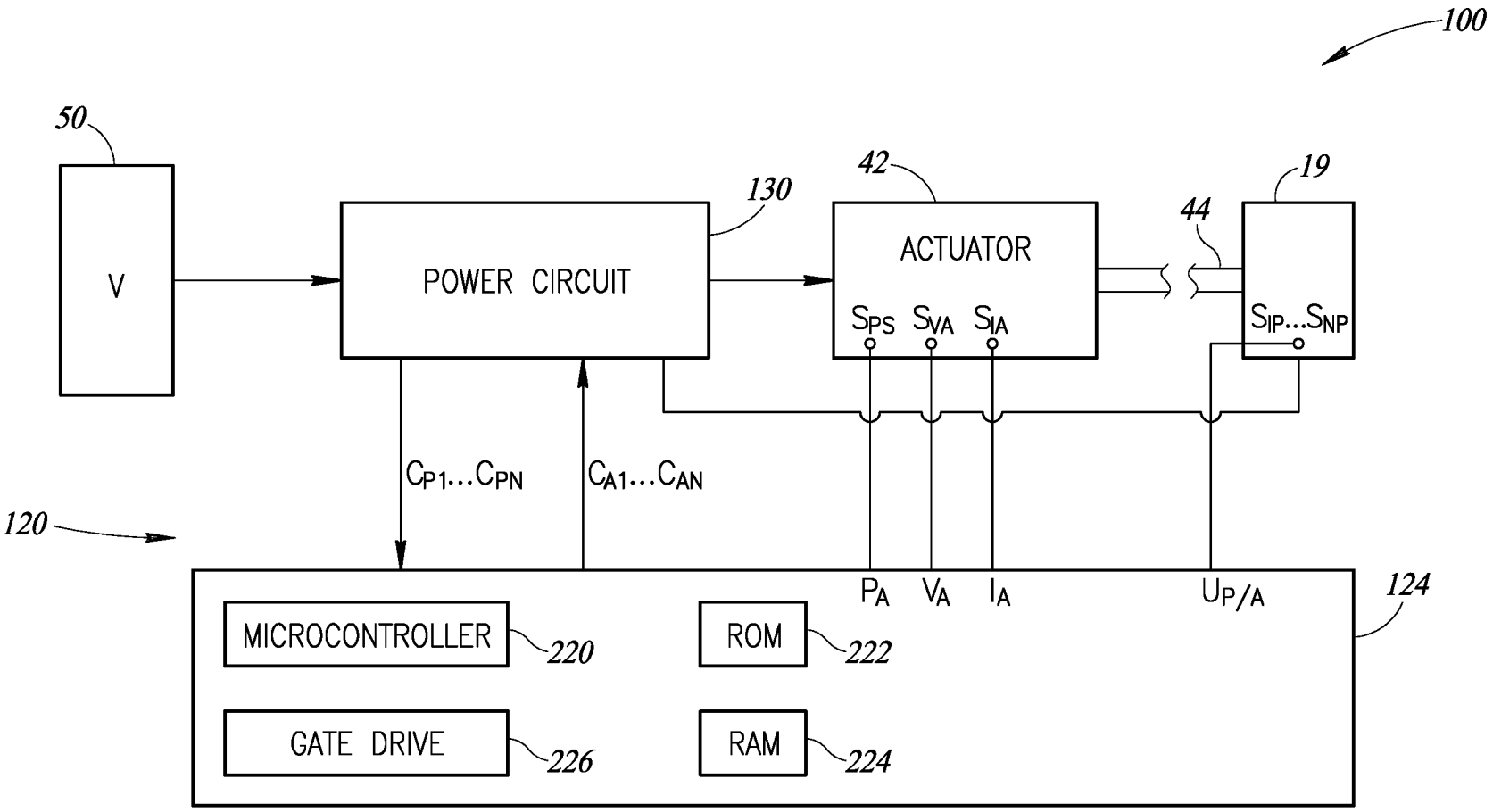
FIG. 5 is a schematic view of a controller of the toilet closure system of FIG. 1.

FIG. 5 schematically illustrates a toilet closure system 100, according to one non-limiting illustrated implementation, which is generally operable to function to close a toilet lid 19 and/or toilet seat 20, as discussed above with respect to the toilet closure system 10. In particular, FIG. 5 shows an implementation which employs the electrical energy storage device(s) 50 to supply or deliver power to the actuator 42 via a control circuit 120. Although not illustrated schematically in FIG. 5, the electrical energy storage device(s) 50 can include a number of electrical terminals, which can be accessible from an exterior of the electrical energy storage device(s) 50 that allow charge to be delivered from the electrical energy storage devices(s) 50 to external components, such as, for example, the actuator 42, one or more sensors, e.g., sensors 46, toilet closure controller 35, etc. For example, in implementations where the electrical energy storage devices(s) 50 are disposed in a battery pack 36, electrical terminals may be disposed in the battery pack 36 that may electrically couple the electrical energy device(s) 50 to various components. As illustrated in FIGS. 1 through 4, the actuator 42 includes the drive shaft 44, which is coupled either directly or indirectly to drive or rotate at least the toilet lid 19 of the toilet 12.

As illustrated and described below, the control circuit 120 includes various components for transforming, conditioning and controlling the transfer of electrical power, particularly between the electrical energy storage device(s) 50 and the actuator 42. The control circuit 120 may take any of a large variety of forms, and will typically include a controller 124, for example, toilet closure controller 35, a power block or power circuit 130, and/or sensors $S_{1P} \ldots S_{NP}$, $S_{IA}$, $S_{VA}$, $S_{PS}$, etc. The power circuit 130 of the control circuit 120 is generally configured to manage the supply of power from the electrical energy storage device(s) 50 to the various components of the toilet closure system 100. While the power circuit 130 is illustrated separate from the controller 124, in some implementations, the power circuit 130 can be a component of the controller 124.

In some implementations, the power circuit 130 may include DC/DC power converter(s) that can couple the electrical energy storage device(s) 50 to supply or deliver power to the actuator 42. For instance, the DC/DC power converter(s) may step up a voltage of electrical power from the electrical energy storage device(s) 50 to a level sufficient to drive the actuator 42 to provide an initial thrust. The initial thrust is generally provided by an initial rotation of the drive shaft 44 that is sufficient to rotate the toilet lid 19 to a position where gravitational forces are sufficient to cause the toilet lid 19 to move to the closed position, as shown, for example, in FIG. 2. For example, in some instances, a 2 to 10 degree rotation of the drive shaft 44 may be sufficient to allow gravitational forces to cause the toilet lid 19 to move to the closed position from the open position, as shown, for example, in FIGS. 1 through 2. The power circuit 130 may include additional DC/DC power converter(s) that may electrically couple the electrical energy storage device(s) 50 to various other components, for example, the controller 124, the sensors $S_{1P} \ldots S_{NP}$, $S_{IA}$, $S_{IV}$, $S_{PS}$, etc.

The DC/DC power converter(s) may take a variety of forms, for example an unregulated or regulated switch mode power converter, which may or may not be isolated. For instance, the DC/DC power converter(s) may take the form of a regulated boost switch mode power converter or buck-boost switch mode power converter.

The DC/DC converter(s) can include one or more buck converters, boost converters, buck-boost converters, or any combination thereof. In some situations, the DC converter(s) may include a buck converter. A buck converter can include any switched device suitable for reducing an input DC voltage to a lower output DC voltage. Typical buck converters include a switching device, for example a pulse wave modulated MOSFET or IGBT that controls the input voltage delivered to an inductor coupled in series and a diode and a capacitor coupled in parallel with the load. In some instances, the DC/DC buck converter may include a synchronous buck converter using one or more switching devices in lieu of the diode found in a conventional buck converter. The use of one or more switching devices such as a second MOSFET or IGBT transistor or transistor array in a synchronous buck converter may advantageously reduce power loss attributable to the diode forward voltage drop that occurs within a standard buck converter. In some situations, at least a portion of the DC/DC converter(s) may include a boost converter. A boost converter can include any device or system suitable for increasing a relatively low input DC voltage to a higher DC output voltage. Such converters may be useful, for example in reducing the number of cells in the battery pack 36 needed to power the actuator 42.

In some implementations, the power circuit 130 may also include a DC/AC power converter, commonly referred to as an inverter that, in a thrust mode or configuration in which the drive shaft 44 is rotated via the initial thrust, couples the electrical energy storage device(s) 50 to supply or deliver power to the actuator 42 via the DC/DC converter(s). The DC/AC power converter may invert electrical power from the DC/DC converter(s) into an AC waveform suitable to drive the actuator 42. The AC wave form may be single phase or multi-phase, for example two- or three-phase AC power. The DC/AC power converter(s) may take a variety of forms, for example an unregulated or a regulated switch mode power converter, which may or may not be isolated. For instance, the DC/AC power converter may take the form of a regulated inverter.

The power circuit 130 can be controlled via control signals $C_{A1} \ldots C_{AN}$ supplied via the controller 124. For example, the controller 124, or some intermediary gate drive circuitry, may supply pulse width modulated gate drive signals to control operation of switches (e.g., metal oxide semiconductor field effect transistors (MOSFETs), or insulated gate bipolar transistors (IGBTs)) of the DC/DC and/or DC/AC power converter(s). The control signals $C_{A1} \ldots C_{AN}$ may effect operation of the actuator 42 by controlling the supply or delivery of power from the electrical energy storage device(s) 50 to the actuator 42. The control signals $C_{A1} \ldots C_{AN}$ may also effect operation of the sensors, for example, $S_{NP}$, $S_{IA}$, $S_{IV}$, $S_{PS}$, by controlling the supply or delivery of power from the electrical energy storage device(s) 50 to the sensors. The control signals $C_{P1} \ldots C_{PN}$ may effect operation of the controller 124 by controlling the supply or delivery of power from the electrical energy storage device(s) 50 to the controller 124.

The controller 124 may take a variety of forms which may include one or more integrated circuits, integrated circuit components, digital circuits, digital circuit components, analog circuits, analog circuit components, and various combinations thereof. As illustrated, the controller 124 includes a microcontroller 221, non-transitory computer or processor-readable memory such as a read only memory (ROM) 222 and/or random access memory (RAM) 224, and may optionally include one or more gate drive circuits 226.

The microcontroller 221 executes logic to control operation of the power system, and may take a variety of forms. For example, the microcontroller 221 may take the form of a microprocessor, programmed logic controller (PLC), programmable gate array (PGA) such as a field programmable gate array (FPGS), an application specific integrated circuit (ASIC), or other such microcontroller device. The ROM 222 may take any variety of forms capable of storing processor executable instructions and/or data to implement the control logic. The RAM 224 may take any variety of forms capable of temporarily retaining processor executable instructions or data. The microcontroller 221, ROM 222, RAM 224 and optional gate drive circuit(s) 226 may be coupled by one or more buses (not shown), including power buses, instructions buses, data buses, address buses, etc. Alternatively, the control logic may be implemented in an analog circuit.

The gate drive circuit(s) 226 may take any of a variety of forms suitable for driving switches (e.g., MOSFETs, IGBTs) of the power converters via drive signals (e.g., PWM gate drive signals). While illustrated as part of the controller 124, one or more gate drive circuits may be between the controller 124 and power converters.

The controller 124 may receive signals from one or more sensors $S_{1P} \ldots S_{NP}$, $S_{IA}$, $S_{IV}$, $S_{PS}$.

A proximity sensor(s) (e.g., time of flight sensor) and/or a touch sensor $S_{1P} \ldots S_{NP}$, for example, one or more sensors 46, may be positioned to sense or detect whether a user is either seated on the toilet seat 20 or is in proximity of the toilet 12 within a certain, defined distance, and provide signals UP/A indicative of whether a user is present or absent within a defined proximity to the toilet 12.

An actuator voltage sensor $S_{VA}$ may be positioned to sense a voltage applied to the actuator, e.g., a voltage across the main electrical power storage device(s) 50, and provide signals $V_A$ indicative of the sensed voltage.

An actuator current sensor $S_{IA}$ may be positioned to sense a current flow through the actuator 42 and provide signals $I_A$ indicative of the sensed current.

An optional actuator drive shaft sensor $S_{PS}$ may be positioned to sense the position of the drive shaft 44, e.g., whether the drive shaft 44 is in a position indicating closed position of the toilet lid 19 or open position of the toilet lid 19, and provide signals $P_A$ indicative of the drive shaft 44 positioning. In some implementations, the actuator drive shaft sensor $S_{PS}$ may sense the position of the drive shaft 44 relative to a reference position of the drive shaft 44.

With continued reference to FIGS. 1 through 5, the toilet closure system 100 is operable to reduce power demands of systems that can close toilet lids in an efficient manner. Unlike toilet closure systems that may require an external power supply, the toilet closure system 100 can provide sufficient power to close toilet lids and/or toilet seats via electrical energy storage device(s) 50 disposed in or on the toilet 12. The controller 124 manages the power consumption of various components of the toilet closure system 100 by providing limited power from the electrical energy storage device(s) (50) to the actuator 42 to drive the drive shaft 44 with sufficient forward thrust to allow gravitational forces to move the toilet lid 19 to the closed configuration, when the proximity sensors and/or touch sensors $S_{1P} \ldots S_{NP}$ sense if a user is not seated on the toilet seat or within a defined proximity to the toilet 12. In instances where the toilet seat 20 is in the open position, the forward thrust provided by the drive shaft 44 of the actuator 42 can be sufficient to move the toilet seat 20 along with the toilet lid 19 due to gravitational forces. Upon providing or delivering power to the actuator 42 for the forward thrust, the controller 124 deactivates or "shuts down" the actuator 42 by removing supply or delivery of power from the electrical energy storage device(s) 50 to the actuator 42 to conserve power supply available from the electrical energy storage device(s) 50. In some implementations, however, the controller 124 can deactivate or "shut down" the actuator by removing supply or delivery of power available from the electrical energy storage device(s) 50 when the toilet lid 19 and/or toilet seat 20 is in the closed position. In such implementations, for example, power can be supplied or delivered to the actuator 42 and/or other components until the toilet lid 19 and/or toilet seat 20 is in the closed position. Moreover, in instances where the proximity sensors and/or touch sensors $S_{1P} \ldots S_{NP}$ sense or detect that the toilet is in use or a user is within a certain defined proximity, the controller 124 is configured in a manner that power is not supplied or delivered to the actuator 42 from the electrical energy storage device(s) 50.

Figure 6:
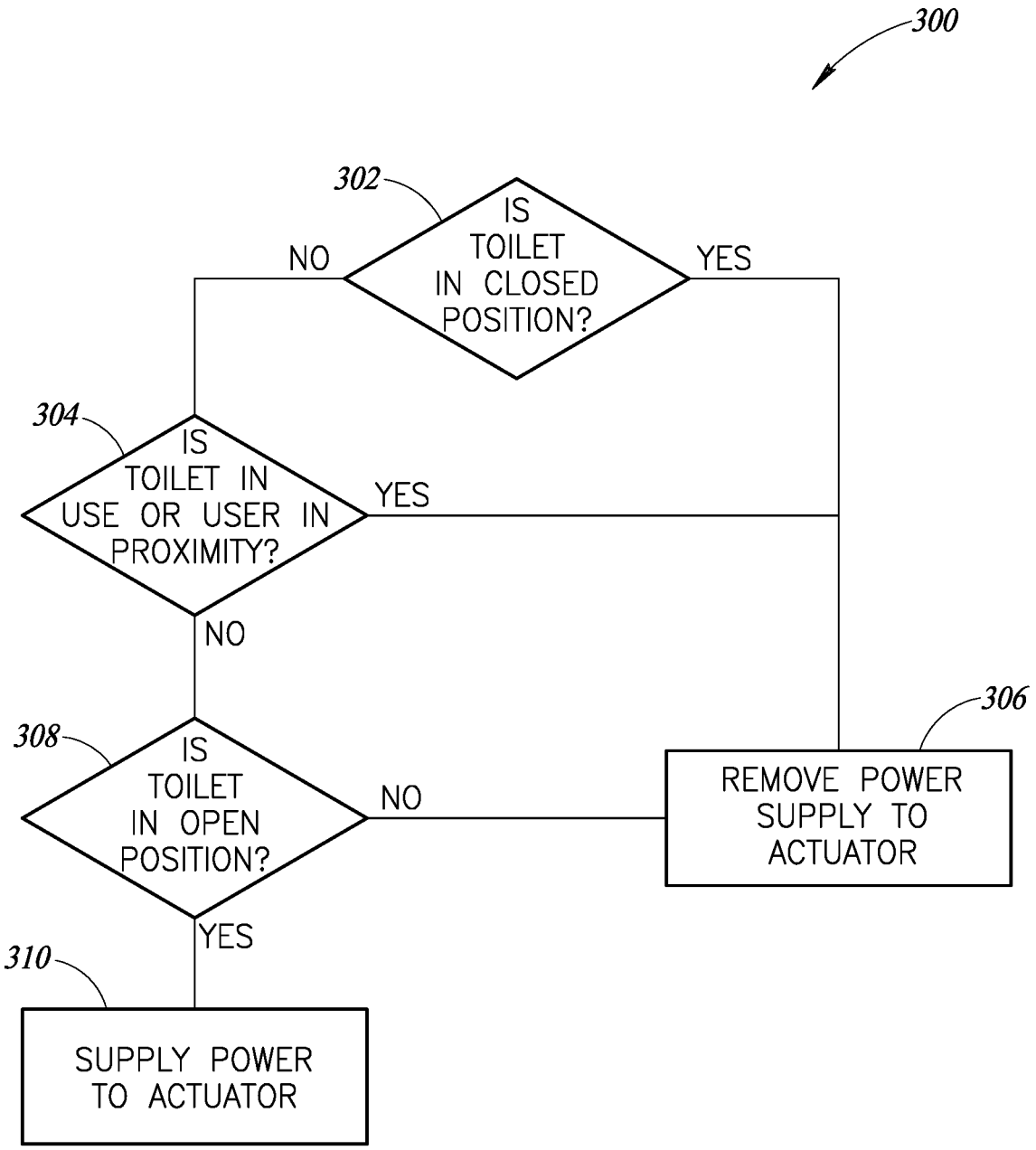
FIG. 6 is a flow diagram illustrating a high level method of operating a toilet closure system, according to one non-limiting example implementation.
Figure 7:
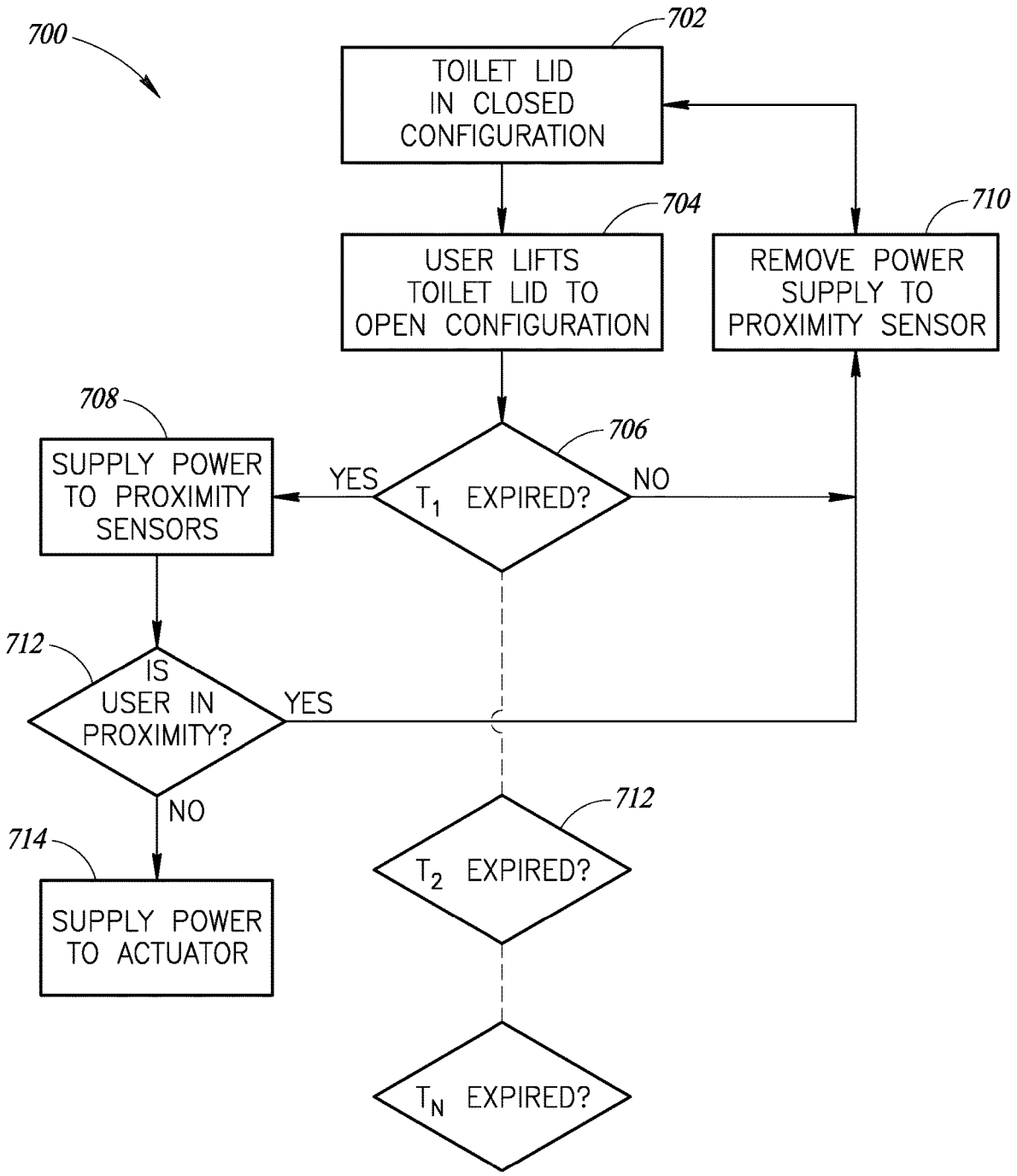
FIG. 7 is a flow diagram illustrating a high level method of operating a toilet closure system, according to one non-limiting example implementation.
Figure 8:
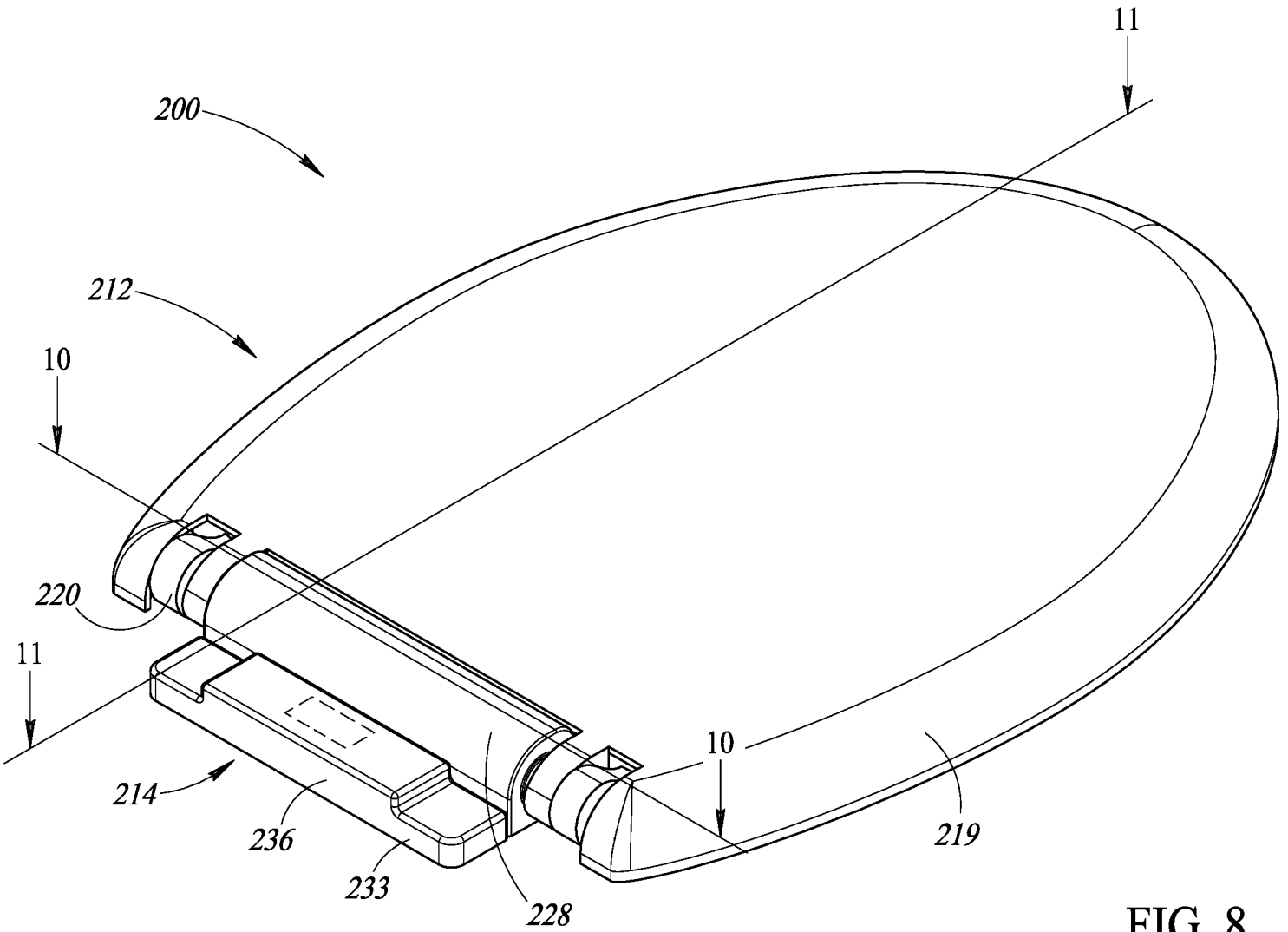
FIG. 8 is a perspective view of a toilet closure system, according to one non-limiting example implementation.
Figure 9:
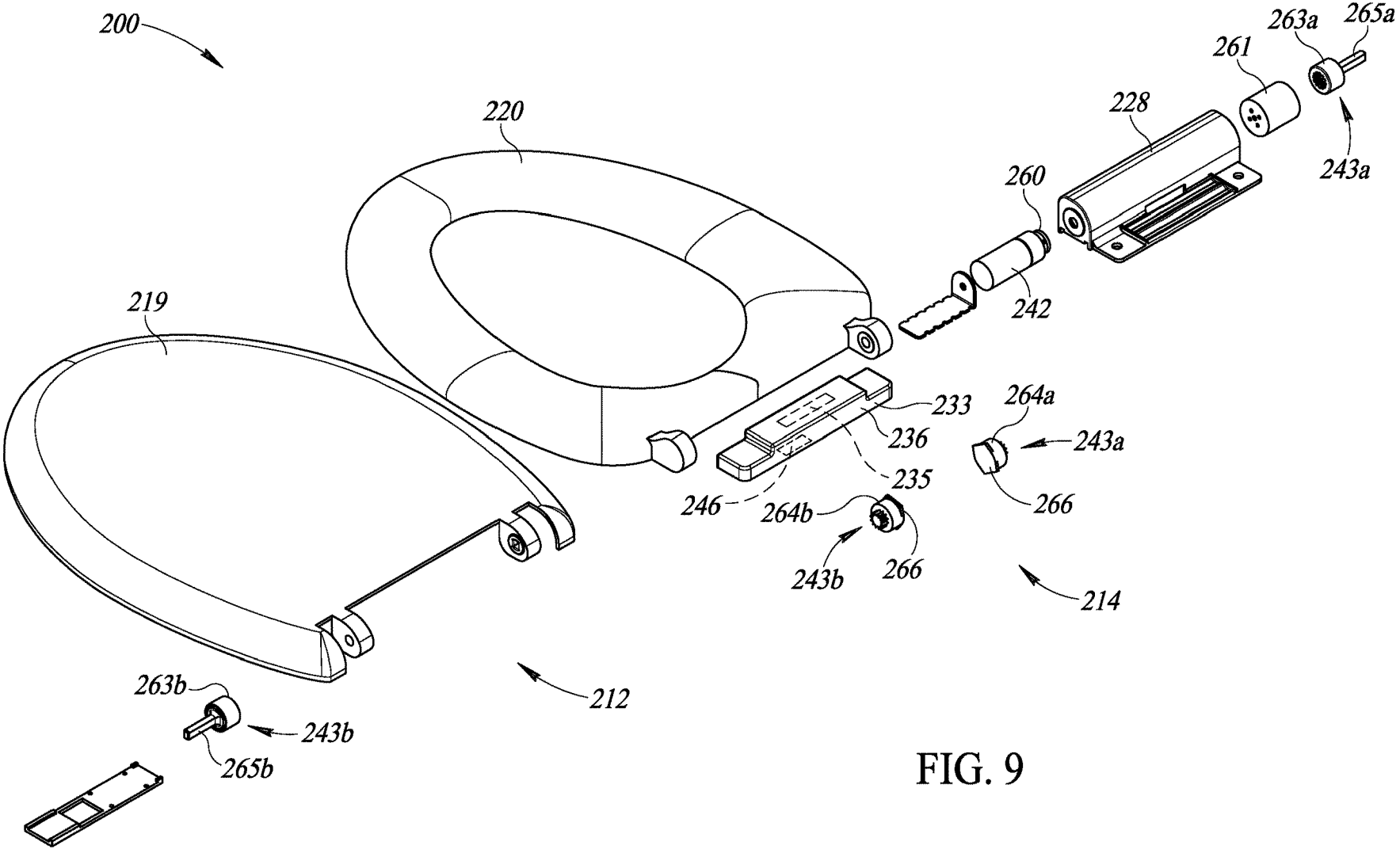
FIG. 9 is an exploded view of the toilet closure system of FIG. 8.
Figure 10:
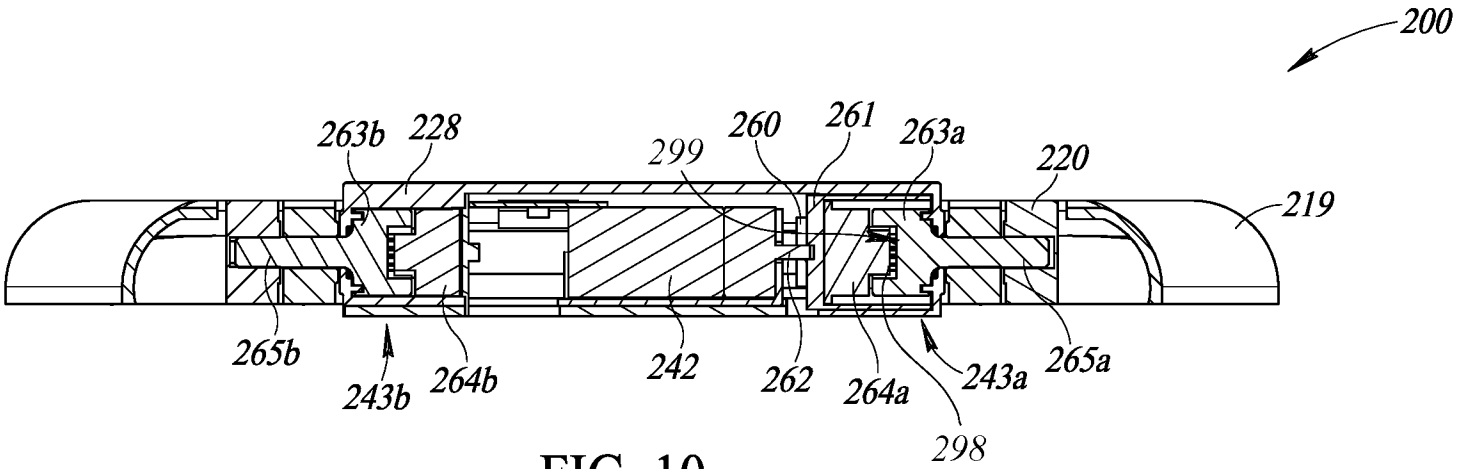
FIG. 10 is a cross-sectional view of the toilet closure system of FIG. 8 taken along lines 10-10.
Figure 11:
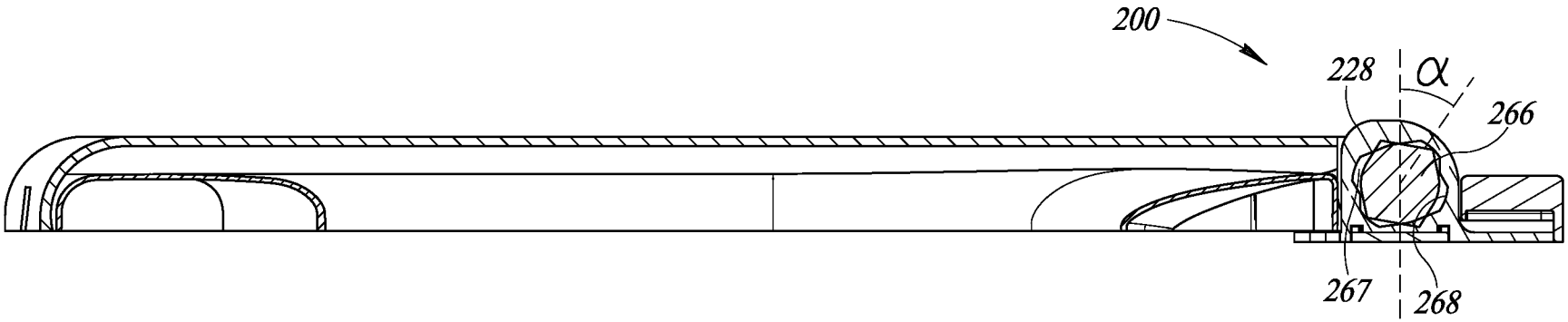
FIG. 11 is a cross-sectional view of the toilet closure system of FIG. 8 taken along lines 11-11.

FIGS. 6 and 7 illustrate methods of operating a controller 124 of a toilet closure system 100 that facilitate power usage efficiencies, according to non-limiting illustrated implementations. In general, the methods are operable by devices that include one or more inputs, which, in operation receive one or more signals indicative of toilet lid 19 positions and one or more signals indicative of user-toilet proximity, for example, if the user is within or outside a threshold distance from the toilet 12. The devices can include control circuitry coupled to the one or more inputs, wherein the control circuitry, in operation, determines a position of a toilet lid 19 based on the one or more signals indicative of toilet lid 19 positions; responds to a determination that the toilet lid 19 is in a closed position by entering a power-save mode of operation; and responds to a determination that the toilet lid 19 is not in a closed position by selectively generating toilet lid actuator control signals to cause the toilet lid actuator 42 to move the toilet lid 19 toward a closed position based on the one or more signals indicative of user-toilet proximity. The power-save mode of operation can include controlling supply or delivery of power from the one or more electrical storage devices 50 to actuator 42, sensors 46, $S_{1P} \ldots S_{NP}$, $S_{IA}$, $S_{VA}$, $S_{PS}$, etc., controllers 35, 100, etc.

Moreover, the methods are also operable by systems that include an actuator, e.g., actuator 42, which, in operation, rotatably moves the toilet lid 19 from an open position toward a closed position; one or more energy storage devices 50; one or more sensors, e.g., sensors 46, $S_{1P} \ldots S_{NP}$, $S_{IA}$, $S_{VA}$, $S_{PS}$, etc. which, in operation, generate one or more signals indicative of toilet lid positions, e.g., closed, open, or any position between closed or open, and one or more signals indicative of user-toilet proximity, e.g., within or outside a threshold distance from the toilet 12; control circuitry coupled to the actuator 42, the one or more energy storage devices 50, and the one or more sensors, e.g., sensors 46, $S_{1P} \ldots S_{NP}$, $S_{IA}$, $S_{VA}$, $S_{PS}$, wherein the control circuitry, in operation: determines a position of a toilet lid 19 based on the one or more signals indicative of toilet-lid positions; responds to a determination that the toilet lid 19 is in a closed position by entering a power-save mode of operation; responds to a determination that the toilet lid 19 is not in a closed position by selectively generating toilet-lid-actuator control signals to cause the toilet-lid-actuator 42 to move the toilet lid 19 toward the closed position based on the one or more signals indicate of user-toilet proximity.

In particular, FIG. 6 illustrates a high-level method 300 of managing power supply of a toilet closure system, according to one, non-limiting implementation.

With reference to FIG. 6, at 302, the toilet closure controller 35, 100 receives a control signal indicative of the positioning of the toilet lid 19, for example, whether the toilet lid 19 is in a closed or open position. For instance, the positioning of the toilet lid 19 can be determined by activation or deactivation of a switch when the toilet lid 19 is moved between positions. In some instances, a force sensor or an accelerometer can determine the positioning of the toilet lid 19. Still further, in some instances, an actuator drive shaft sensor $S_{PS}$ may be positioned to sense the position of the drive shaft 42, e.g., whether the drive shaft 44 is in a position indicating closed position of the toilet lid 19 or open position of the toilet lid 19, or any position therebetween. At 304, if the toilet lid 19 is in an open position, the controller 124 receives a control signal indicative of whether the toilet 12 is in use or whether the user is within a certain, defined proximity. Whether the toilet 12 is in the closed position at 302, the toilet 12 is in use or a user is within a certain, defined proximity, at 304, the controller 124 adjusts or removes power supply or delivery from the electrical energy storage device(s) 50 to the actuator 42 at 306.

At 308, if it is determined that the toilet 12 is not in use or that a user is not within the certain, defined proximity, for example via proximity sensors and/or touch sensors $S_{1P} \ldots S_{NP}$, the controller 124 determines whether the toilet lid is still in the open position to address instances where the user may use the override mechanism and manually close the toilet lid 19. For example, in some implementations, as the toilet lid 19 is moved to the closed position from the open position, or vice versa, as discussed above, a switch may be activated which may communicate to the controller 124 the positioning of the toilet lid 19. In some implementations, the optional actuator drive shaft sensor $S_{PS}$ may be positioned to sense the position of the drive shaft, e.g., whether the actuator drive shaft 44 is in a position indicating open or closed position, and communicate to the controller 124 that can compare the position of the actuator drive shaft 44 with a reference position thereof, for example. In some implementations, a force sensor, e.g., an accelerometer may determine if the toilet lid 19 is in the open or closed position. At 310, if the toilet lid is still in the open position and the toilet 12 is not in use, or a user is not within the certain, defined proximity, the controller 124 sends a control signal to the electrical energy storage device(s) 50 to supply or deliver power to the actuator 42 to rotate the drive shaft 44 with a forward thrust, such forward thrust being sufficient to rotate the toilet lid 19 to a position where gravitational forces allow the toilet lid 19 to be moved to the closed position. In some implementations, the method may include a lag or a delay of a certain defined time interval between the identification of the user not being within the certain, defined proximity and the closure of the toilet lid 19. In some implementations, the lag or delay can be around 30 seconds, or other suitable time. Upon movement of the toilet lid 19 to the open position, the drive shaft 44 of the actuator 42 may return to its initial position, where the actuator drive shaft sensor $S_p$s, for example, may send control signals to the controller 124 indicative of the drive shaft 44 position.

FIG. 7 illustrates a timer-implemented power management method 700 that uses one or more timers to measure, for example, any number of time intervals, $T_1$, $T_2 \ldots T_N$. The time intervals can be used by the controller 124 to automatically control power supplied to the one or more proximity sensors and/or touch sensors $S_{1P} \ldots S_{NP}$. At 702, the toilet lid 19 is in the closed position, which causes the toilet closure system, e.g., toilet closure system 10, 100 to be in a deep-sleep mode. In the deep-sleep mode, the proximity sensors and/or touch sensors $S_{1P} \ldots S_{NP}$, among other components of the toilet closure system 10, 100, for example, actuator 42, other sensors, etc., receive limited, if any, power supply from the electrical energy storage device(s) 50. In some implementations, the deep-sleep mode can include a power-off mode where, when the toilet is in the closed position, no power is supplied from the electrical energy storage device(s) 50 to the one or more components of the toilet closure system 10, 100. In such implementations, opening of the toilet lid 19 from the closed position can trigger supply or delivery of power from the electrical energy storage device(s) 50 to the one or more components of the toilet closure system 10, 100, for example, actuator 42, other sensors, etc.

At 704, a user lifts the toilet lid 19 from the closed position to the open position. Lifting of the toilet lid 19 triggers the toilet closure system 10, 100 to switch to a wake mode. In the wake mode, the controller 124 activates the proximity sensors and/or touch sensors $S_{1P} \ldots S_{NP}$ and the one or more timers. In particular, the controller 124 activates the proximity sensors and/or touch sensors $S_{1P} \ldots S_{NP}$ at defined time intervals by supplying or delivering power from the electrical energy storage device(s) 50 to the proximity sensors and/or touch sensors $S_{1P} \ldots S_{NP}$. In some implementations, the defined intervals can range from between 5 to 30 seconds. In some implementations, the defined time intervals can be longer, for example, 60 seconds, 90 seconds, etc. Moreover, in some implementations, the defined time interval can vary between the different time intervals, for example, first time interval, second time interval, third time interval, etc., where one or more of the time intervals can be different.

At 706, upon expiration of a first time interval $T_1$, the controller 124, switched to the wake mode, activates the proximity sensors and/or touch sensors $S_{1P} \ldots S_{NP}$ at 708 by supplying or delivering power to the proximity sensors and/or touch sensors $S_{1P} \ldots S_{NP}$ from the electrical energy storage device(s) 50.

At 710, in between the time intervals, the toilet closure system 10, 100 is returned to and maintained at deep-sleep mode, during which power supply or delivery to the proximity sensors and/or touch sensors $S_{1P} \ldots S_{NP}$ from the electrical energy storage device(s) is removed.

At 712, the proximity sensors and/or touch sensors $S_{1P} \ldots S_{NP}$ detect whether a user is seated on the toilet seat 20 or is within a defined proximity of the toilet 12. If the user is not seated on the toilet seat 20 or within the defined proximity, at 714, the controller 124 activates the actuator 42 by supplying or delivering power from the electrical energy storage device(s) 50 to the actuator 42 to provide forward thrust by rotating the drive shaft 44. The method 700 proceeds from 714 to 710 to remove or limit power after closing the toilet lid 19.

If the user is seated on the toilet seat 20 or within the defined proximity of the toilet 12, the toilet closure system 10 returns to the deep-sleep mode and removes the supply or delivery of power from the electrical energy storage device(s) 50 to the proximity sensors and/or touch sensors $S_{1P} \ldots S_{NP}$, until the expiration of the next time interval $T_2$. Again, after the expiration of the next time interval $T_2$, the toilet closure system 10, 100 is switched to the wake mode and activates the proximity sensors and/or touch sensors $S_{1P} \ldots S_{NP}$ by supplying or delivering power to the proximity sensors and/or touch sensors $S_{1P} \ldots S_{NP}$ from the electrical energy storage device(s) 50. Thereafter, the proximity sensors and/or touch sensors $S_{1P} \ldots S_{NP}$ detect whether a user is seated on the toilet seat 20 or is within a defined proximity of the toilet 12. If the user is not seated on the toilet seat 20 or within the defined proximity, the controller 124 activates the actuator 42 by supplying or delivering power from the electrical energy storage device(s) 50 to the actuator 42 to provide forward thrust by rotating the drive shaft 44. As illustrated in FIG. 7, the timer-implemented power management method 700 can have any number of time intervals $T_N$, whereby the toilet closure system 10, 100 can be switched between deep-sleep and wake modes to determine whether the user is no longer seated on the toilet seat 20 or within the defined proximity before activating the actuator 42.

FIGS. 8-11 illustrate a toilet closure system 200, according to another non-limiting implementation. The toilet closure system 200 is generally similar to the toilet closure system 10 with certain variations and can be implemented and included in any of the systems, methods, apparatuses described above. The toilet closure system 200 includes a toilet 212 (illustrated with certain components removed for clarity of illustration and description) and a thrust system 214, where the toilet 212 includes a toilet lid 219 and a toilet seat 220. The thrust system 214 provides certain variations. The thrust system 214 includes a housing 228 having a control compartment 233. The control compartment 233 includes a toilet closure controller 235 and a battery pack 236, and one or more sensors 246. The thrust system 214 also includes an actuator 242 and a pair of dampers, specifically, a lid damper 243*a* and a seat damper 243*b*.

The actuator 242 is received in the housing 228 and includes a coupling element 260 that couples the actuator 242 to an actuator coupling 261. The actuator coupling 261 is generally hollow and sized and shaped to receive the lid damper 243*a*. A shaft component 262 of the actuator 242 couples the actuator 242 to the actuator coupling 261. As described above, the lid damper 243*a* is coupleably received in the actuator coupling 261. Thus, rotatable movement of the actuator 242 can cause rotatable movement of the actuator coupling 261 and the lid damper 243*a* received therein.

In some implementations, the lid damper 243*a* includes a damper shaft component 263*a* coupled to a continuous damper 264*a* via the actuator coupling 261. For example, as shown in detail in FIG. 10, an end of the continuous damper 264*a* is received in the actuator coupling 261, and another end is received in the damper shaft component 263*a*. In particular, the continuous damper 264*a* includes a continuous damper shaft component 298, and the damper shaft component 263*a* includes a receiving recess 299. The receiving recess 299 coupleably and engagingly receives the continuous damper shaft component 298. In other implementations, however, the lid damper 243*a* may include a damper shaft component 264*a* only, a through shaft damper, or other dampers known in the art. Further, in some implementations, the actuator coupling 261 may be excluded. For example, in an implementation, a shaft portion of the actuator 242 may be coupled to the continuous damper 264*a* with the continuous damper 264*a* coupled or affixed to the toilet lid 219, or in another implementation, the shaft portion of the actuator 242 may be coupled to a through shaft damper. In such implementations, the continuous damper 264*a* can be sized and shaped to allow the toilet lid 219 to be rotatably moveable between open and closed positions independent of the shaft of the actuator 242. The damper shaft component 263*a* includes a damper shaft 265*a* that has a rectangular or square shape that extends through and engages a rectangular or square-shaped slot in the toilet lid 219. In this manner, as the actuator 242 is driven, such causes rotary movement of the actuator coupling 261 and the lid damper 243*a*, which in turn causes the damper shaft 265*a* to engage and rotate with the toilet lid 219. As described above, in some implementations, the lid damper 243*a* includes a continuous damper 264*a*. The continuous damper 264*a* is sized and shaped to allow the damper shaft component 263*a* to be rotatable relative to the continuous damper 264*a*. In particular, the actuator 642 via the coupling element 260 is fixedly coupled to the continuous damper 264*a* through the actuator coupling 261. The damper shaft component 263*a*, however, is coupled to the actuator 642 via the continuous damper 264*a* such that the damper shaft component 263*a* is moveable relative to the actuator 642.

In this manner, during operation, a user may manually move the toilet lid 219 from the open position to the closed position in a counterclockwise direction, for example, wherein the damper shaft component 263*a* moves with the toilet lid 219 but relative to, or independent of, the actuator 642 via the continuous damper 264*a*. Similarly, if a user manually moves the toilet lid 219 from the closed position to the open position in a clockwise direction, for example, the damper shaft component 263*a* moves in the clockwise direction with the toilet lid 219 relative to the actuator 642 via the continuous damper 264*a*.

The seat damper 243*b* also includes a damper shaft component 263*b* coupled to a continuous damper 264*b*. The damper shaft component 263*b* also includes a damper shaft 265*b* that has a rectangular or square shape that extends through and engages a rectangular or square-shaped slot in the toilet seat 220. As illustrated in FIGS. 8 to 11, the continuous damper 264*b* includes a stop bracket 266. The stop bracket 266 is sized and shaped to be received in a recess 267 disposed in the housing 228. In particular, the recess 267 is sized and shaped to allow the seat damper 243*b* to freely rotate for a certain rotary angle $\alpha$, for example 30 degrees. Upon free rotation of the seat damper 243*b* to the rotary angle $\alpha$, the stop bracket 266 contacts or engages a body 268 of the housing 228, which restricts, limits, or prevents the free rotation of the stop bracket 266, and consequently the continuous damper 264*b*. Upon this contact or engagement, the seat damper 243*b* can no longer freely rotate, which causes engagement of the seat damper 243*b* and dampens the toilet seat 220 as it is moved from the open to closed position. In this manner, the seat damper 243*b* freely rotates for a rotary angle $\alpha$, for example, 30 degrees, and then engages the housing 228, which causes movement of the toilet seat 220 to be damped by the seat damper 243*b*. Thus, in operation, if the toilet seat 220 is in an open position, for example, and a user rotates it toward a closed position by pushing the toilet seat 220 down, such movement will cause the seat damper 243*b* to freely rotate up to the rotary angle until the stop bracket 266 contacts the housing 228. Thereafter, the seat damper 243*b* is engaged and dampens the movement of the toilet seat 220. In some implementations, the thrust system 214 may also include a biasing member, such as a torsional spring, that is sized and shaped to bias or move the seat damper 243*b* to its initial position, e.g., position prior to rotation up to the rotary angle α. Again, the seat damper 243*b* may take other forms, such as a through shaft damper, or other dampers known in the art.

While the above operative example described if a user moves the toilet seat 220, in an instance where both toilet lid 219 and the toilet seat 220 are in the open or upright position, the actuator 242 can be activated to move the toilet lid 219 toward the closed position, which movement can concurrently cause the toilet seat 220 to move to the closed position. Again, in such an instance, this movement of the toilet seat 220 will cause the seat damper 243*b* to freely rotate up to the rotary angle α until the stop bracket 266 contacts the housing 228. Thereafter, the seat damper 243*b* is activated and dampens the movement of the toilet seat 220 from the open position to the closed position.

In addition, in some implementations, the toilet lid 219 may, in lieu of, or in addition to, the lid damper 243*a*, also include a seat damper or one with similar functionality. For example, the housing 228 may include another recess to facilitate a stop bracket 266 of the lid damper 243*a* disposed around the continuous damper 264*a*. In such an implementation, again, the lid damper 243*a* can freely rotate until the stop bracket 266 contacts or engages the recess in the housing 228, at which point the lid damper 243*a* is activated and can dampen the movement of the toilet lid 219 from the open to the closed position. Thus, in operation, the actuator 242 can move the toilet lid 219 up to the rotary angle α, which allows the lid damper 243*a* to freely rotate in the housing 228. Upon reaching the rotary angle α, the actuator 242 can be deactivated as the gravitational forces are sufficient to move the toilet lid 219 to the closed position, while the stop bracket 266 engages the recess in the housing 228 and movement of the toilet lid 219 from the open position to the closed position is dampened. Again, as described above, the continuous damper 264*a* allows the damper shaft component 263*a* to move with the toilet lid 219 and relative to the actuator 242. Thus, if the actuator 242 moves the toilet lid 219 up to the rotary angle α, the actuator 242 can thereafter be deactivated and the damper shaft component 263*a* can move the toilet lid 219 to the closed position independent of the actuator 242.

In some implementations, the thrust system 214 may include a seat damper 243*b* and exclude a lid damper 243*a*. In such an implementation, the actuator 642 may drive the toilet lid 219 from the open to the closed position, or the actuator 642 may drive the toilet lid 219 up to the rotary angle α, and thereafter any gears in the actuator 642 may function as a damper as the toilet lid 219 moves toward the closed position.

Figure 12:
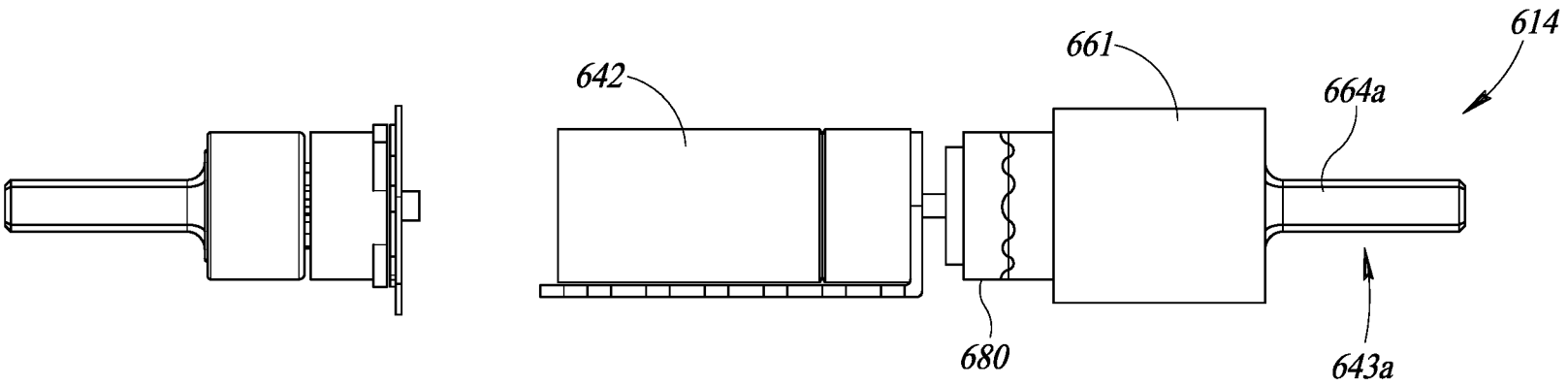
FIG. 12 is a side view of a thrust system, according to one non-limiting example implementation.

In some implementations, a toilet closure system similar to one or more toilet closure systems described herein may optionally include a clutch, for example, a slip clutch. For example, in some implementations, a user's motion to quickly close or open the toilet lid and/or toilet seat may exceed certain torque capacities of an actuator, such as a motor. In such situations, it is possible that an actuator may be damaged or may need to be sized and shaped to have the torque capability to react to such quick response times. For example, FIG. 12 illustrates a side view of a thrust system 614 that is similar to the other thrust systems described herein, with certain variations, that allows the thrust system 614 to react to a wide variety of response times. In particular, the thrust system 614 includes a slip clutch 680 that is positioned between an actuator 642 and an actuator coupling 661. In some implementations, however, the slip clutch 680 may be positioned between an actuator 642 and any damper, e.g., an implementation that excludes an actuator coupling 661. The slip clutch 680 is configured to engage or disengage the actuator 642 from a lid damper 643*a*. Thus, for example, if closing or opening the toilet lid may result in a torque that exceeds the capability of the actuator 642, the slip clutch 680 may disengage the actuator 642 from a damper shaft component 664*a* of the lid damper 643*a* to prevent damage to the actuator 642. Similarly, the slip clutch 680 may engage the actuator 642 to the damper shaft component 664*a* of the lid damper 643*a* when the torque being applied by closing or opening the toilet lid 219 is within a defined torque threshold, or the slip clutch 680 may remain engaged with the actuator 642 and the lid damper 643*a* and only disengage when a certain defined torque threshold is exceeded. In this manner, damage to the actuator 642 may be avoided or prevented.

In some implementations, one or more of the toilet closure systems described above can be removably coupleable to a toilet. For example, the toilet lids and/or the toilet seats and/or the thrust systems can individually or collectively be removable from a base of the toilet for cleaning or maintenance purposed.

Moreover, the various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A device, comprising:

a toilet closure system including a housing configured to, in operation, be mounted to a toilet;

one or more proximity sensors within the housing, which, in operation, sense user-toilet proximity;

one or more inputs, which, in operation, receive one or more signals indicative of toilet-lid positions and one or more signals indicative of user-toilet proximity; and control circuitry coupled to the one or more inputs, wherein the control circuitry, in operation:

determines a position of a toilet lid based on the one or more signals indicative of toilet-lid positions;

responds to a determination that the toilet lid is in a closed position by entering a power-save mode of operation; and responds to a determination that the toilet lid is not in a closed position by selectively generating, based on the one or more signals indicative of user-toilet proximity, toilet-lid-actuator control signals to cause a toilet-lid-actuator within the housing to move the toilet lid toward a closed position;

responds to a determination that the toilet lid is being lifted from the closed position towards the opened position by entering a wake mode of operation;

one or more electrical energy storage devices within the housing, and wherein the control circuitry selectively removes delivery of power from the one or more electrical energy storage devices to the one or more proximity sensors in the power-save mode of operation, and wherein the control circuitry selectively allows delivery of power from the one or more electrical storage devices to the one or more proximity sensors in the wake mode of operation.

2. The device of claim 1 wherein the control circuitry selectively generates one or more proximity-sensor-power control signals to deliver power from one or more electrical energy storage devices to the one or more proximity sensors over one or more defined time intervals.

3. The device of claim 1 wherein the control circuitry removes supply of power from the one or more electrical energy storage devices to the toilet-lid-actuator in the power-save mode of operation.

4. The device of claim 1 wherein the control circuitry delivers power from the one or more electrical energy storage devices to the toilet-lid-actuator based on the one or more signals indicative of user-toilet proximity.

5. The device of claim 1 wherein the control circuitry is contained within the housing.

6. The device of claim 5 wherein the housing includes a control compartment in which the control circuitry and the one or more electrical energy storage devices are contained.

7. The device of claim 1 further comprising one or more position sensors that determine the position of the toilet lid.

8. The device of claim 1 wherein the housing includes a pair of sidewalls configured to, in operation, be positioned adjacent to hinges of the toilet.

9. A system, comprising:

a toilet closure system including a housing configured to, in operation, be mounted to a toilet;

an actuator contained within the housing, which, in operation, rotatably moves a toilet lid from an open position toward a closed position;

one or more electrical energy storage devices contained within the housing;

one or more sensors, which, in operation, generate one or more signals indicative of toilet-lid positions and one or more signals indicative of user-toilet proximity, at least one of the one or more sensors contained within the housing, and the at least one of the one or more sensors is a proximity sensor that senses user-toilet proximity;

control circuitry contained within the housing and coupled to the actuator, the one or more electrical energy storage devices, and the one or more sensors, wherein the control circuitry, in operation:

determines a position of a toilet lid based on the one or more signals indicative of toilet-lid positions;

responds to a determination that the toilet lid is in a closed position by entering a power-save mode of operation;

responds to a determination that the toilet lid is being lifted from the closed position towards the opened position by entering a wake mode of operation;

responds to a determination that the toilet lid is not in a closed position by selectively generating toilet-lid-actuator control signals to cause the actuator to move the toilet lid toward the closed position based on the one or more signals indicative of user-toilet proximity, and wherein the control circuitry selectively removes delivery of power from the one or more electrical energy storage devices to the one or more sensors and to the actuator in the power-save mode of operation, wherein the control circuitry selectively allows delivery of power from the one or more electrical energy storage devices to one or more of the one or more sensors and the actuator in the wake mode of operation.

10. The system of claim 9, comprising the toilet lid and a housing mounted to the toilet lid, wherein the actuator, the one or more electrical energy storage devices, at least one of the one or more sensors, and the control circuitry are contained within the housing.

11. The device of claim 10 wherein the housing includes a pair of sidewalls configured to, in operation, be positioned adjacent to hinges of the toilet.

12. The system of claim 9, comprising a toilet.

13. The system of claim 9 wherein the control circuitry selectively generates one or more proximity-sensor-power signals to remove delivery of power from the one or more electrical energy storage devices to the one or more sensors that generate indications of user-toilet proximity in the power-save mode of operation.

14. The system of claim 9 wherein the control circuitry selectively generates one or more power-actuator-signals to remove delivery of power from the one or more electrical energy storage devices to the actuator in the power-save mode of operation.

15. The system of claim 9 wherein the control circuitry selectively generates one or more power-actuator-signals to deliver power from the one or more electrical energy storage devices to the actuator based on the one or more signals indicative of user-toilet proximity.

16. The system of claim 9 wherein the control circuitry selectively generates one or more proximity-sensor-power control signals to deliver power from one or more electrical energy storage devices to the one or more sensors that generate indications of user-toilet proximity over one or more defined time intervals.

17. The system of claim 9 wherein the actuator, in operation, only rotatably moves a toilet lid from the open position toward the closed position.

18. The system of claim 9 wherein the actuator, in operation, does not rotatably move the toilet lid from the closed position to the open position.

19. A method comprising:

determining by a toilet closure system, a position of a toilet lid;

determining by the toilet closure system, a user-toilet-proximity with one or more proximity sensors within a housing of the toilet closure system configured to, in operation, be mounted to a region of a toilet;

responsive to the toilet lid being in a closed position, entering a power-save mode of operation;

responsive to the toilet lid being in an open position and the user-toilet-proximity, selectively causing a toilet-lid-actuator within the housing to move the toilet lid toward a closed position;

responsive to the toilet lid being lifted from the closed position towards the opened position, entering a wake mode of operation;

determining by a control circuitry within the housing and communicatively coupled to one or more proximity sensors if a user is not within a defined proximity; and checking whether the user is not within the defined proximity, prior to the control circuitry selectively causing the toilet-lid-actuator to move the toilet lid toward a closed position, and wherein, in the power-save mode of operation, the control circuitry removes delivery of power to the toilet-lid actuator and the one or more proximity sensors, and wherein, in the wake mode of operation, the control circuitry allows delivery of power to one or more of the toilet-lid actuator and the one or more proximity sensors.

20. The method of claim 19 comprising selectively removing delivery of power from one or more electrical energy storage devices to one or more proximity sensors in the power-save mode of operation.

21. The method of claim 19 further comprising selectively removing delivery of power from one or more electrical energy storage devices within the housing to the toilet-lid-actuator in the power-save mode of operation.

22. The method of claim 19 further comprising selectively delivering power from one or more electrical energy storage devices within the housing to the toilet-lid-actuator based on user-toilet-proximity.

23. The method of claim 19 comprising selectively delivering power from one or more electrical energy storage devices within the housing to one or more proximity sensors over one or more defined time intervals.

24. A device, comprising:

a toilet closure system including a housing configured to, in operation, be mounted to a toilet;

one or more proximity sensors within the housing, which, in operation, sense user-toilet proximity;

one or more inputs, which, in operation, receive one or more signals indicative of toilet-lid positions and one or more signals indicative of user-toilet proximity; and control circuitry within the housing and coupled to the one or more inputs, wherein the control circuitry, in operation:

determines a position of a toilet lid based on the one or more signals indicative of toilet-lid positions;

responds to a determination that the toilet lid is in a closed position by entering a power-save mode of operation;

responds to a determination that the toilet lid is not in a closed position by selectively generating, based on the one or more signals indicative of user-toilet proximity, toilet-lid-actuator control signals to cause a toilet-lid-actuator within the housing to move the toilet lid toward the closed position; and responds to a determination that the toilet lid is being lifted from the closed position towards the opened position by entering a wake mode of operation, and wherein the control circuitry selectively removes delivery of power to the one or more proximity sensors in the power-save mode of operation, and wherein the control circuitry selectively allows delivery of power to the one or more proximity sensors in the wake mode of operation.

* * * * *